US006359386B1

(12) United States Patent
Von Morgen et al.

(10) Patent No.: US 6,359,386 B1
(45) Date of Patent: Mar. 19, 2002

(54) ELECTRIC LAMP WITH METAL SHELL

(75) Inventors: Gijsbert L. Von Morgen; Gerardus H. A. M. Van Der Steen; Josephus J. Timmermans, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/464,003

(22) Filed: Dec. 15, 1999

(30) Foreign Application Priority Data

Dec. 21, 1998 (EP) ..... 98204378

(51) Int. Cl.[7] ..... H01J 17/18

(52) U.S. Cl. ..... 313/623; 313/625; 313/624

(58) Field of Search ..... 313/623, 624, 313/625, 634

(56) References Cited

U.S. PATENT DOCUMENTS

| | | | | |
|---|---|---|---|---|
| 4,677,338 | A | 6/1987 | Dixon et al. | 313/43 |
| 5,107,177 | A | 4/1992 | Barthelmes et al. | 313/623 |
| 5,304,892 | A | 4/1994 | Lewandowski et al. | 313/623 |
| 5,461,277 | A | 10/1995 | Van Gennip et al. | 313/331 |

FOREIGN PATENT DOCUMENTS

| | | | |
|---|---|---|---|
| DE | 1589309 | 3/1970 | H01J/61/36 |
| GB | 469978 | 8/1937 | |

*Primary Examiner*—Vip Patel
(74) *Attorney, Agent, or Firm*—Dicran Halajian

(57) ABSTRACT

The electric lamp comprises a lamp vessel (1) in which an electric element (2) is arranged. The electric element (2) is connected to feedthroughs (3, 4) that extend through the wall of the lamp vessel (1). The respective feedthroughs (3, 4) comprise a metal shell (7) and an internal current conductor (13) connected thereto. The metal shell (7), which has no knife edge, clamps around the neck-shaped end portion (5, 6) of the lamp vessel (1), hence realizing the gastightness of the feedthrough.

8 Claims, 1 Drawing Sheet

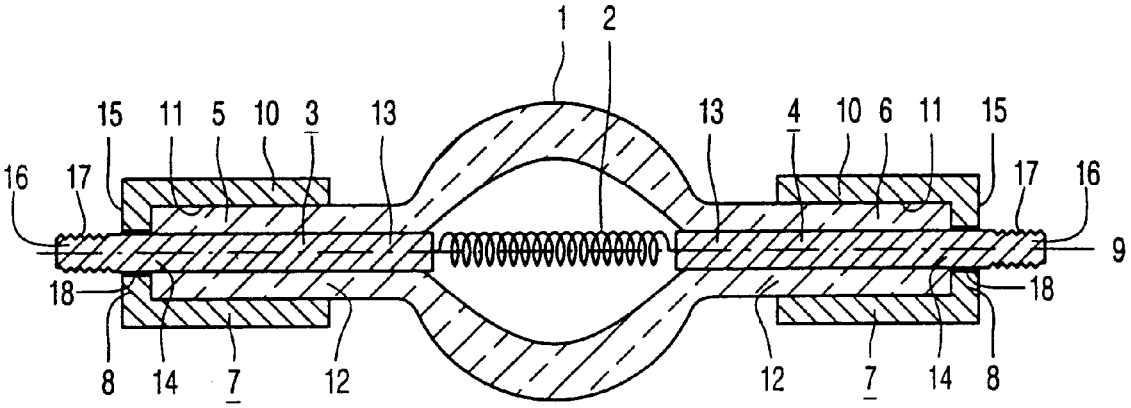
1
2
15
11
5
10
3
13
13
4
10
6
11
15
16
17
17
16
9
18
18
8
14
7
12
12
7
14
8

ELECTRIC LAMP WITH METAL SHELL

BACKGROUND OF THE INVENTION

The invention relates to an electric lamp comprising:

a glass lamp vessel sealed in a gastight manner and having an $SiO_2$ content of at least 95% by weight;

an electric element arranged in the lamp vessel;

current feedthroughs projecting from the lamp vessel to the exterior and connected to the electric element, comprising:

a metal shell having a gastight bottom and an open end opposite the bottom, and a raised gastight wall surrounding an axis and having an inner surface;

an internal current conductor having an end piece which is connected in a gastight manner to the bottom, which internal current conductor extends from the bottom to beyond the open side of the metal shell and into the lamp vessel and is connected to the electric element, one end of the lamp vessel having a direct gastight fuse with the metal shell.

A lamp of this type is known from DE 15 89 309. The known lamp has a current feedthrough in which the raised circular gastight wall on the open end of the metal shell has a knife edge. The shell is intended to be embedded with its entire raised wall in the quartz glass of the lamp vessel. The embedded raised wall has formed a gastight fuse with the quartz glass so that the gastightness of the feedthrough of the lamp is achieved. The raised wall is surrounded both on its inner side and its outer side by quartz glass which is fused with substantially the complete inner surface and with a part of the outer surface located proximate to the knife edge.

When manufacturing the known lamp, a seal is made enclosing the metal shell in the quartz glass of the lamp vessel. At the location where this seal is to be created, the quartz glass is caused to soften in the presence of the metal shell, the internal current conductor and an electric element, whereafter cooling takes place. The raised wall of the metal shell shrinks due to its relatively high coefficient of expansion (approximately $50*10^{-7}$ $K^{-1}$) more strongly than the quartz glass in which it is embedded, while the coefficient of expansion of the quartz glass is approximately $6*10^{-7}$ $K^{-1}$. Since the raised wall of the metal shell is provided with a knife edge, no capillary formation will occur due to deformation of the relatively mechanically weak knife edge, which deformation also obviates the occurrence of too high stresses in the quartz glass. There is no fuse of the quartz glass with the internal current conductor which is therefore not embedded in the quartz glass.

A drawback of the known feedthrough is that the knife edge is mechanically weak and can easily be damaged. The risk of a premature end of the life due to too high stresses in the quartz glass and/or the absence of a gastight fuse between the metal shell and the quartz glass has thus increased considerably. A second drawback is that the method of manufacturing the known lamp is relatively cumbersome.

SUMMARY OF THE INVENTION

According to the invention, the metal shell encloses the end of the lamp vessel, the metal shell being free from a knife edge.

The lamp according to the invention can be manufactured in a simple manner. Since the metal shell is free from a knife edge, the manufacture of the shell is considerably simplified, for example, by deep drawing from a metal plate and, moreover, the edge of the metal shell is not vulnerable. The risk of damage is thus reduced when inserting the end of the lamp vessel into the shell and, consequently, the risks of problems in the formation of a direct, gastight fuse with the metal shell are also reduced. After heating, the end of the lamp vessel inserted into the metal shell is directly fused in a gastight manner with the inner side of the raised wall and with the internal current conductor. Since the metal shell is not completely embedded in the glass of the lamp vessel but encloses its end and is directly fused in a gastight manner exclusively with its inner side of its raised wall to the glass of the lamp vessel, the manufacture of the lamp is further simplified. The fuse is achieved by, for example, high-frequency heating of the metal shell with the end inserted into it to a high temperature, for example approximately 2000° C., in an inert or slightly reducing atmosphere. As a result of a relatively great difference in coefficients of expansion of the quartz glass and the internal current conductor embedded therein, a capillary is present in the cooled state around the internal current conductor. However, for the same reason of a relatively large difference in coefficients of expansion, the end of the lamp vessel in the cooled state is surrounded in a clamping manner by the raised wall of the metal shell so that the direct, gastight fuse of the metal shell with the lamp vessel is improved.

In one embodiment, the metal shell and/or the internal current conductor of the lamp comprise tungsten and/or molybdenum. For establishing the direct, gastight fuse between the metal shell and the quartz glass at a high temperature, the quartz glass must be fluid but the metal shell as well as the internal current conductor must keep their shape. An internal current conductor and a metal shell comprising tungsten, molybdenum and/or mixtures thereof have been found to be eminently suitable for this purpose.

In another embodiment, the metal shell of the lamp comprises a percentage by weight of at most 10% of an additive. Since the dope has been added to the shell, there is not only a physical adhesion but also a chemical adhesion between the metal shell and the quartz glass. Consequently, the adhesion between the metal shell and the quartz glass is improved so that the direct, gastight fuse is further improved.

In a further embodiment of the lamp, the additive comprises an element chosen from the group of rhenium, thorium, yttrium, lanthanum. It has been found that these elements added as additives to the metal shell lead to a very good adhesion between the metal shell and the quartz glass. The direct, gastight fuse is even further enhanced thereby. The additive may be present as a coating on the current feedthrough but may be alternatively distributed in a homogeneous manner in the mass of the current feedthrough.

In a further embodiment, the metal shell in the lamp is provided with an external current conductor on a side of the bottom facing away from the open side, in which the external current conductor may be provided with coupling means. The external conductor can then be easily welded or, if it is provided with, for example, a screw thread, it can easily be connected or screwed to external electric contacts.

In yet another embodiment of the lamp, a current conductor comprising the internal current conductor and the external conductor is passed in a gastight manner through an aperture in the bottom. To this end, the current conductor is connected by means of a gastight welding/soldering compound to the bottom through which it is passed. Since the internal current conductor and the external current conductor consist of one piece, this construction has the advantage that it can be manufactured in a relatively easy way and is relatively strong.

A feedthrough is known from GB 469 978 in which the quartz glass is adhered to the metal shell by means of a sintered coating of finely divided refractory metal which is provided on the quartz glass. This has the drawback that the manufacture of the feedthrough is relatively cumbersome because a coating must be provided, and that the manufacture should take place carefully because the quartz body must maintain its shape. Moreover, the quartz glass has no direct fuse with the metal shell, which may be detrimental to the gastightness of the connection between the metal shell and the quartz glass.

The electric element may comprise, for example, a filament body, in which case the lamp vessel may comprise a halogen-containing filling with a rare gas. On the other hand, the electric element may also comprise an electrode pair. In that case, the lamp has an ionizable filling, for example a filling of rare gas such as xenon, for example, at a pressure of several, for example 7, bar outside the operating condition, and one or more metal halides, possibly with mercury.

The lamp may be incorporated in a reflector which may be closed with a front glass, for example a shield or a lens. The lamp vessel may be covered with an interference filter. The lamp vessel may have an outer, for example quartz glass, envelope which may be connected to the lamp vessel and the envelope may be, for example, UV absorbing.

The electric lamp may be provided with, for example, a set of plates on which one or more feedthroughs are provided, or the feedthroughs may be arranged, for example, opposite each other.

BRIEF DESCRIPTION OF THE DRAWINGS

In the drawing:

FIG. 1 is a cross-sectional view of an electric lamp according to the invention.

DETAILED DESCRIPTION OF THE PREFERRED EMBODIMENTS

In FIG. 1, the electric lamp according to the invention is a halogen incandescent lamp with a quartz glass lamp vessel 1 which is sealed in a gastight manner. An electric element 2, a filament body in the Figure, is arranged in the lamp vessel 1 and connected to respective current feedthroughs 3 and 4 projecting to the exterior through respective neck-shaped ends 5 and 6 of the lamp vessel 1. The respective current feedthroughs each comprise a metal shell 7 made of molybdenum in the Figure, having a bottom 8, 4 raised gastight wall 10 surrounding an axis 9 and an inner surface 11 and an open end 12 opposite the bottom 8. The metal shell has a wall thickness of 0.1 mm, a height of 4 mm and a diameter of 4 mm. The respective current feedthroughs 3 and 4 also comprise an internal current conductor 13 with a diameter of 0.2 mm, and an external current conductor 16 which is connected in a gastight manner to the bottom 8 and extends from the bottom 8 to beyond the open end 12. The internal conductor 13 is axially surrounded by a respective quartz glass neck-shaped end 5, 6. The metal shell 7 has a gastight fuse with the respective neck-shaped ends 5 and 6 only with its inner surface 11 of the raised wall 10 and is free from a knife edge on its open end 12. The metal shell 7 is connected in a gastight manner with external current conductor 16 in aperture 18 of the bottom 8. The internal current conductor 13 and the external current conductor 16 jointly constitute the current feedthrough which consists of one piece 14 and is connected in a gastight manner to the bottom 8 by means of laser welding. The external current conductor 16 is provided with coupling means 17, a screw thread in the Figure.

In the lamp shown in the Figure, the lamp vessel 1 has a xenon gas filling with a pressure of 800 mbar outside operating conditions and has a power consumption of 35 W at a voltage of 12 V in operation.

The internal current conductor 13 and the external current conductor 16 are made of molybdenum but may be alternatively made of tungsten or rhenium. If they are made of tungsten, they may comprise a small content of crystal growth-regulating means so as to influence the grain size of the tungsten, for example, a total of 0.01% by weight of K, Al and Si.

What is claimed is:

1. An electric lamp comprising:

a glass lamp vessel (1) sealed in a gastight manner and having an $SiO_2$ content of at least 95% by weight, said lamp vessel having a pair of opposed ends (5, 6) and a central axis (9) extending through said ends (5, 6);

an electric element (2) arranged in the lamp vessel (1) on said axis (9);

current feedthroughs (3, 4) projecting from the lamp vessel (1) to the exterior and connected to the electric element (2), each feedthrough comprising:

a metal shell (7) having a gastight bottom (8) and an open end (12) opposite the bottom (8), and a raised gastight wall (10) surrounding an axis (9) and having an inner surface (11);

an external current conductor (16) which is connected in a gastight manner to the bottom (8), and an internal current conductor (13) which extends from the bottom (8) on said axis (9) and into the lamp vessel (1) and is connected to the electric element (2), each said end (5, 6) of the lamp vessel (1) having a direct gastight fuse with the inner surface of the metal shell (7), wherein the metal shell (7) encloses the end (5, 6) of the lamp vessel (1), the open end (12) of the metal shell (7) being free from a knife edge.

2. An electric lamp as claimed in claim 1, characterized in that the metal shell (7) and/or the internal current conductor (13) comprise tungsten and/or molybdenum.

3. An electric lamp as claimed in claim 2, characterized in that the metal shell (7) and/or the internal current conductor (13) comprise a percentage by weight of at most 10% of an additive.

4. An electric lamp as claimed in claim 3, characterized in that the additive comprises an element chosen from the group of rhenium, thorium, yttrium, lanthanum.

5. An electric lamp as claimed in claim 4, characterized in that the external current conductor (16) is provided with coupling means (17).

6. An electric lamp as in claim 1 wherein said metal shells are welded to said external current conductors.

7. An electric lamp as in claim 1 wherein each said bottom is provided with an aperture on said axis, said external current passing through said aperture.

8. An electric lamp as in claim 1 wherein said internal current conductor and said external current conductor are formed as a single integral piece.

* * * * *